US006919393B2

(12) United States Patent
Mano et al.

(10) Patent No.: US 6,919,393 B2
(45) Date of Patent: Jul. 19, 2005

(54) SOLID GOLF BALL

(75) Inventors: Satoshi Mano, Kobe (JP); Masatoshi Yokota, Kobe (JP)

(73) Assignee: SRI Sports Limited, Kobe (JP)

( * ) Notice: Subject to any disclaimer, the term of this patent is extended or adjusted under 35 U.S.C. 154(b) by 7 days.

(21) Appl. No.: 10/309,235

(22) Filed: Dec. 4, 2002

(65) Prior Publication Data

US 2003/0144425 A1 Jul. 31, 2003

(30) Foreign Application Priority Data

Dec. 4, 2001 (JP) ..... 2001-369941

(51) Int. Cl.[7] ..... A63B 37/06; C08K 5/08

(52) U.S. Cl. ..... 524/347; 525/261; 525/274; 473/371; 473/372; 473/377

(58) Field of Search ..... 524/347; 525/261, 525/274; 473/371, 372, 377

(56) References Cited

U.S. PATENT DOCUMENTS

| | | | | |
|---|---|---|---|---|
| 4,570,937 A | | 2/1986 | Yamada | |
| 4,858,924 A | | 8/1989 | Saito et al. | |
| 5,002,281 A | * | 3/1991 | Nakahara et al. | 473/373 |
| 5,033,748 A | | 7/1991 | Ebisuno | |
| 5,490,673 A | | 2/1996 | Hiraoka | |
| 5,516,110 A | | 5/1996 | Yabuki et al. | |
| 5,645,496 A | | 7/1997 | Endo et al. | |
| 5,803,834 A | | 9/1998 | Yamagishi et al. | |
| 6,315,683 B1 | * | 11/2001 | Yoshida et al. | 473/375 |
| 6,339,119 B1 | * | 1/2002 | Ladd et al. | 524/336 |
| 6,494,794 B1 | | 12/2002 | Ohama | |
| 6,561,929 B2 | * | 5/2003 | Watanabe | 473/377 |
| 6,666,780 B2 | * | 12/2003 | Watanabe | 473/373 |

FOREIGN PATENT DOCUMENTS

| | | | |
|---|---|---|---|
| JP | 5-44302 B2 | | 7/1993 |
| JP | 2000271249 | * | 10/2000 |
| JP | 2001-104518 A | | 4/2001 |

* cited by examiner

*Primary Examiner*—David J. Buttner
(74) *Attorney, Agent, or Firm*—Birch, Stewart, Kolasch & Birch, LLP

(57) ABSTRACT

The present invention provides a solid golf ball having exceptional rebound characteristics and flight performance, as well as good shot feel. The present invention relates to a solid golf ball comprising at least one layer of a core, and at least one layer of a cover formed on the core, wherein at least one layer including the inmost layer of the core is formed by vulcanizing a rubber composition comprising a base rubber, a co-crosslinking agent, a vulcanization initiator and a filler, the core has a center hardness in JIS-C hardness of 40 to 60, a surface hardness in JIS-C hardness of 80 to 95 and a hardness difference (B−A) between a hardness in JIS-C hardness at a distance of 5 mm from the center point of the core (B) and the center hardness (A) of not less than 1 to less than 10.

11 Claims, 1 Drawing Sheet

SOLID GOLF BALL

FIELD OF THE INVENTION

The present invention relates to a solid golf ball which has exceptional rebound characteristics and flight performance, as well as a good shot feel.

BACKGROUND OF THE INVENTION

Hitherto, there have been mainly produced two types of golf balls. The one is a solid golf ball, such as a two-piece golf ball or a three-piece golf ball, which is composed of a core formed from integrally molded rubber material and a thermoplastic resin cover (e.g. ionomer resin cover) formed on the core. The other is a thread wound golf ball which is composed of a solid or liquid center, a thread rubber wound layer formed on the center and a cover of ionomer resin or balata (trans-polyisoprene) etc. having a thickness of 1 to 2 mm covering on the thread rubber wound layer. In the solid golf ball, a two-piece solid golf ball is composed of a core and a cover, and has been commercially available since 1982, because of easiness of production and the like. The two-piece solid golf ball has better durability and better flight performance because of larger initial velocity at the time of hitting and longer flight distance, when compared with the thread wound golf ball. Therefore, the two-piece solid golf ball is generally approved or employed by many golfers, mainly an average class of golfers.

On the other hand, the two-piece solid golf ball exhibits much harder shot feel at the time of hitting than the thread wound golf ball. Therefore, the two-piece solid golf ball is not approved nor employed by some users such as elderly persons or women who are non-muscular golfers. In order to improve shot feel, it has been attempted to soften the core by reducing a hardness of the core. The method improves the shot feel, but adversely sacrifices flight distance, because the rebound characteristics are degraded.

Recently, the two-piece solid golf ball has approved or employed by professional golfers or top amateur golfers other than the non-muscular golfers, because the two-piece solid golf ball has excellent flight performance and uniformity of quality between golf balls. The professional golfers or top amateur golfers require not only good shot feel but suitable controllability. The ionomer resin, which has been generally used for cover materials of two-piece solid golf balls, however shows high rigidity and high hardness, in order to impart sufficient flight performance and durability to the golf ball, and thus deteriorating controllability.

In order to solve the above problem, a golf ball, of which a cover is formed from a resin having low rigidity and low hardness, has been proposed. The reduction of rigidity and hardness of the cover improves controllability, but it is problem that the reduction degrades rebound characteristics of the cover, thus the resulting golf ball not having sufficient flight performance.

In order to further improve performances of the two-piece solid golf ball, there has been many proposals. In Japanese Patent Kokoku Publication Nos. 21426/1986, 44302/1993 and 98206/1994, and Japanese Patent Kokai Publication Nos. 182278/1990, 98949/1994, 154357/1994, 327792/1994, 194732/1995, 239067/1997, 104518/2001 and the like, two-piece solid golf balls are proposed, of which performances such as flight distance (rebound characteristics), durability, shot feel, controllability are improved by adjusting hardness and hardness distribution of core to proper ranges.

In Japanese Patent Kokoku Publication No. 21426/1986, a two-piece golf ball, of which hardness distribution is controlled such that a core has a hardness in JIS-C hardness at the surface layer of 72 to 78, a hardness in JIS-C hardness at the distance of 5 mm from the surface layer of 77 to 83, a hardness in JIS-C hardness at the distance of 10 mm from the surface layer of 72 to 80, a hardness in JIS-C hardness at the distance of 15 mm from the surface layer of 67 to 75 and a hardness in JIS-C hardness at the distance of more than 15 mm from the surface layer of not more than 75, is disclosed. However, in the golf ball, since hardness distribution near the surface of the core is not adjusted to a proper range, rebound characteristics are not sufficiently obtained.

In Japanese Patent Kokoku Publication No. 44302/1993, a two-piece golf ball having a deformation amount when applying from an initial load of 10 kgf to a final load of 130 kgf of 1.9 to 2.4 mm, of which hardness distribution is cotrolled such that a core has a hardness in JIS-C hardness at the distance of less than 10 mm from the center point of the core of 60 to 79 and a hardness in JIS-C hardness at the distance of more than 10 mm from the center point of the core of 80 to 90, is disclosed. However, in the golf ball, since the deformation amount of the golf ball is small, shot feel is poor.

In Japanese Patent Kokoku Publication No. 98206/1994, a two-piece golf ball, of which hardness distribution is cotrolled such that hardness difference in JIS-A hardness between the center point and a portion other than the center point of the core is within the range of −10 to 10%, is disclosed. However, in the golf ball, since the hardness difference between the center point and a portion other than the center point of the core is only considered, both good shot feel and excellent flight performance are not obtained.

In Japanese Patent Kokai Publication No. 182278/1990, a two-piece golf ball, of which core hardness is decreased substantially from the surface to the center point in order, and a relationship between the hardness and a distance from the surface of the core is adjusted to a specified range, is disclosed. However, in the golf ball, since the center hardness of the core is also high, shot feel is poor.

In Japanese Patent Kokai Publication No. 98949/1994, a two-piece golf ball, of which hardness distribution is controlled such that core hardness is increased at the center point, at the distance of 5 to 10 mm from the center point, at the distance of 15 mm from the center point and the surface in order, is disclosed. However, in the golf ball, since hardness distribution of the core is not adjusted to a proper range, shot feel is poor.

In Japanese Patent Kokai Publication No. 327792/1994, a two-piece golf ball, of which hardness distribution is controlled such that the core has a hardness in JIS-C hardness at the center point of 65 to 79, a hardness in JIS-C hardness at the distance of 5 mm from the center point of 70 to 80, a hardness in JIS-C hardness at the distance of 10 mm from the center point of 73 to 80, a hardness in JIS-C hardness at the distance of 15 mm from the center point of 75 to 82 and a hardness in JIS-C hardness at the surface of 70 to 85, and hardness difference between the two measuring points adjacent to each other in the core is within the range of −5 to 5, is disclosed. However, in the golf ball, since the hardness at the center point of the core is high, shot feel is poor.

In Japanese Patent Kokai Publication No. 194732/1995, a two-piece golf ball, of which a core has a center hardness in JIS-C hardness of 40 to 57, a surface hardness in JIS-C hardness of 70 to 95 and hardness difference between the surface hardness and center hardness of 20 to 40, is disclosed. However, in the golf ball, since the hardness near the center point of the core is significantly high, shot feel is poor.

In Japanese Patent Kokai Publication No. 239067/1997, a two-piece golf ball having hardness distribution such that a core has a surface hardness in JIS-C hardness of not more than 85, a center hardness in JIS-C hardness is lower than the surface hardness by 8 to 20 and a hardness at the distance of not more than 5 mm from the surface is lower than the surface hardness by not more than 8, is disclosed. However, in the golf ball, since the hardness distribution of the core is not adjusted to a proper range, shot feel is poor.

In Japanese Patent Kokai Publication No. 104518/2001, a two-piece golf ball comprising a core and a cover is disclosed. In the golf ball, assuming that a center hardness in JIS-C hardness of the core is A, a hardness in JIS-C hardness at the distance of not more than 5 mm from the surface of the core is B, a surface hardness in JIS-C hardness of the core is C, a hardness in JIS-C hardness of the cover is D, a distance between the center point and the point of not more than 5 mm from the surface of the core is K and a radius of the golf ball is L, the value of A is within the range of not less than 58 to lower than 65, the value of B is within the range of 80 to 87, the value of C is higher than 78, the value of C is lower than that of B by 1 to 5, and the values of A, B, D, K and L satisfy a relationship represented by the following formula:

$$0.9 \leqq \{(D-B)/(L-K)\}/\{(B-A)/K\} \leqq 2.0$$

However, in the golf ball, since the hardness distribution near the surface of the core is not adjusted to a proper range, rebound characteristics are not sufficiently obtained.

It has been required to provide golf balls having good shot feel, of which the flight performance and durability are improved, by solving the problems. In addition, it is required to improve the performance of the golf ball still more.

OBJECTS OF THE INVENTION

A main object of the present invention is to provide a solid golf ball which has exceptional rebound characteristics and flight performance, as well as a good shot feel.

According to the present invention, the object described above has been accomplished by adjusting the center hardness, the surface hardness and hardness difference (B−A) between the hardness at a distance of 5 mm from the center point (B) and the center hardness (A) of the core to specified ranges, thereby providing a solid golf ball which has exceptional rebound characteristics and flight performance, as well as a good shot feel.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

Figure 1:
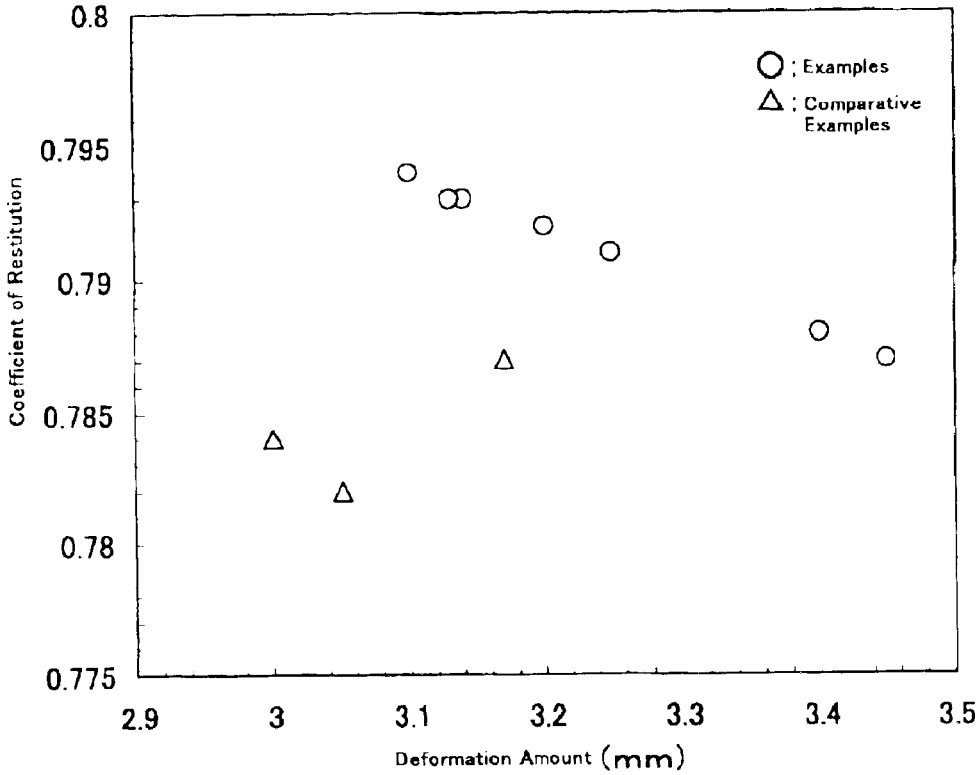
FIG. 1 is a graph displaying the relationship between deformation amount (x-axis) and coefficient of restitution (y-axis) of the core in the golf ball of the present invention.

The present invention relates to a solid golf ball comprising at least one layer of a core, and at least one layer of a cover formed on the core, wherein at least one layer including the inmost layer of the core is formed by vulcanizing a rubber composition comprising a base rubber, a co-crosslinking agent, a vulcanization initiator and a filler, the core has a center hardness in JIS-C hardness of 40 to 60, a surface hardness in JIS-C hardness of 80 to 95 and a hardness difference (B−A) between a hardness in JIS-C hardness at a distance of 5 mm from the center point of the core (B) and the center hardness (A) of not less than 1 to less than 10.

Generally, when the core has small hardness difference, that is, the core has nearly even hardness distribution, energy loss from deformation of the core at the time of hitting is small, and rebound characteristics are sufficiently obtained. However, since hardness near the center point of the core is high, shot feel of the resulting golf ball is hard and poor. When the core has inclined hardness distribution such that the center point is soft and the surface is hard, shot feel is soft and good. However, when hardness at the surface of the core is too high, the shot feel of the resulting golf ball is poor. In addition, rebound characteristics are degraded. The present inventors have accomplished the balance between excellent rebound characteristics and flight performance, and good shot feel by adjusting the center hardness, the surface hardness and hardness difference (B−A) between the hardness at a distance of 5 mm from the center point (B) and the center hardness (A) of the core to specified ranges as described above.

In order to put the present invention into a more suitable practical application, it is desired that the rubber composition for the core comprise at least one organic sulfur compound selected from the group consisting of compounds which are represented by (i) the following formula (1):

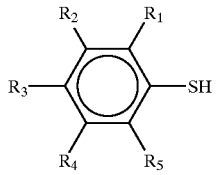

(wherein $R_1$ to $R_5$ are independently a hydrogen or a substituent group), (ii) formula (2):

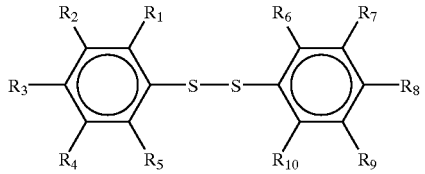

(wherein $R_1$ to $R_{10}$ are independently a hydrogen or a substituent group), (iii) formula (3):

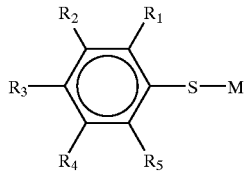

(wherein $R_1$ to $R_5$ are independently a hydrogen or a substituent group, and M represents a monovalent metal atom) and (iv) formula (4):

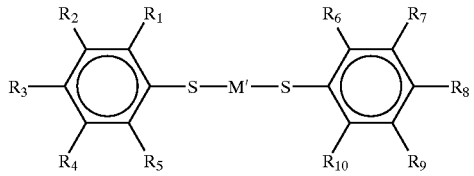

(wherein $R_1$ to $R_{10}$ are independently a hydrogen or a substituent group, and M' represents a bivalent metal atom) and the substituent be selected from the group (A) consisting of halogen group (F, Cl, Br, I), alkyl group, carboxyl group (—COOH) or ester thereof (—COOR), formyl group (—CHO), acyl group (—COR), halogenated carbonyl group (—COX), sulfo group (—$SO_3H$) or ester thereof (—$SO_3R$), halogenated sulfonyl group (—$SO_2X$), sulfino group (—$SO_2H$), alkylsulfinyl group (—SOR), carbamoyl group (—$CONH_2$), halogenated alkyl group, cyano group (—CN), alkoxy group (—OR) and combinations thereof;

the rubber composition for the core comprises further at least one hydroquinone compound selected from the group consisting of compounds which are represented by the following formula (5):

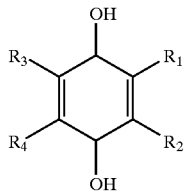

(wherein $R_1$ to $R_4$ are independently a hydrogen or a substituent group) and the substituent is selected from the group (A) consisting of halogen group (F, Cl, Br, I), alkyl group, carboxyl group (—COOH) or ester thereof (—COOR), formyl group (—CHO), acyl group (—COR), halogenated carbonyl group (—COX), sulfo group (—$SO_3H$) or ester thereof (—$SO_3R$), halogenated sulfonyl group (—$SO_2X$), sulfino group (—$SO_2H$), alkylsulfinyl group (—SOR), carbamoyl group (—$CONH_2$), halogenated alkyl group, cyano group (—CN), alkoxy group (—OR) and combinations thereof; and the organic sulfur compound further contain another substituent group selected from the group (B) consisting of nitro group (—$NO_2$), amino group (—$NH_2$), hydroxyl group (—OH) and phenylthio group (—SPh), when the organic sulfur compound has at least one of the substituent group (A).

DETAILED DESCRIPTION OF THE INVENTION

The solid golf ball of the present invention is composed of at least one layer of a core and at least one layer of a cover formed on the core. At least one layer of the core is formed by vulcanizing and press-molding a rubber composition using a method and condition, which has been conventionally employed for solid cores. The rubber composition contains a base rubber, co-crosslinking agent, vulcanization initiator, filler and the like. The other layer of the core, which is not limited, may be formed from thermoplastic resin, which has been conventionally used for cover layers.

The base rubber may be natural rubber and/or synthetic rubber, which has been conventionally used for solid golf balls. Preferred is high cis-polybutadiene rubber containing a cis-1,4 bond of not less than 40%, preferably not less than 80%. The polybutadiene rubber may be mixed with natural rubber, polyisoprene rubber, styrene-butadiene rubber (SBR), ethylene-propylene-diene rubber (EPDM), and the like.

The co-crosslinking agent includes monovalent or divalent metal salts, such as zinc or magnesium salts of α,β-unsaturated carboxylic acids having 3 to 8 carbon atoms (e.g. acrylic acid, methacrylic acid, etc.). The preferred co-crosslinking agent is zinc acrylate, because it imparts high rebound characteristics to the resulting golf ball. The amount of the co-crosslinking agent is from 20 to 45 parts by weight, preferably from 25 to 40 parts by weight, more preferably from 30 to 40 parts by weight, based on 100 parts by weight of the base rubber. When the amount of the co-crosslinking agent is larger than 45 parts by weight, the resulting golf ball is too hard, and the shot feel is poor. On the other hand, when the amount of the co-crosslinking agent is smaller than 20 parts by weight, the core is too soft, and the rebound characteristics are degraded or the shot feel is poor.

The vulcanization initiator includes organic peroxide, such as dicumyl peroxide, 1,1-bis(t-butylperoxy)-3,3,5-trimethyl cyclohexane, 2,5-dimethyl-2,5-di(t-butylperoxy) hexane, t-butyl peroxide and the like. The preferred organic peroxide is dicumyl peroxide. In the golf ball of the present invention, the amount of the vulcanization initiator is from 0.05 to 3.0 parts by weight, preferably from 0.1 to 2.5 parts by weight, based on 100 parts by weight of the base rubber. When the amount of the vulcanization initiator is smaller than 0.05 parts by weight, the core is too soft, and the rebound characteristics are degraded, which reduces the flight distance of the resulting golf ball. On the other hand, when the amount of the vulcanization initiator is larger than 3.0 parts by weight, it is required to decrease the amount of the co-crosslinking agent in order to obtain a desired hardness, and the rebound characteristics are degraded.

The filler, which is mainly used as a specific gravity adjuster for adjusting the specific gravity of the resulting golf ball as end product to the range of 1.0 to 1.3, can be one that has typically used for the core of golf balls, but includes for example, inorganic filler (such as zinc oxide, barium sulfate, calcium carbonate and the like), high specific gravity metal powder filler (such as tungsten powder, molybdenum powder and the like), and the mixture thereof. Particularly preferred is zinc oxide, which also acts as a vulcanizing aid. When the zinc oxide is used as the filler, the amount of the filler is from 2 to 15 parts by weight, preferably from 3 to 10 parts by weight, based on 100 parts by weight of the base rubber. When the amount of the filler is smaller than 2 parts by weight, the rebound characteristics are not sufficiently obtained. On the other hand, when the amount of the filler is larger than 15 parts by weight, the weight ratio of the rubber component in the core is small, and high rebound characteristics are not sufficiently obtained. As the filler other than the zinc oxide, which used for the core of the present invention, fillers having high specific gravity are preferable.

The rubber compositions for the core of the golf ball of the present invention can contain an organic sulfur compound in addition to the above components. The organic sulfur compound includes at least one organic sulfur compound selected from the group consisting of compounds which are represented by (i) the following formula (1):

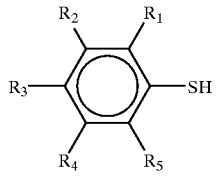

(wherein $R_1$ to $R_5$ are independently a hydrogen or a substituent group), (ii) formula (2):

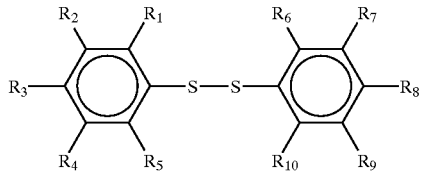

(wherein $R_1$ to $R_{10}$ are independently a hydrogen or a substituent group), (iii) formula (3):

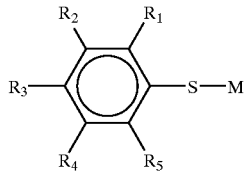

(wherein $R_1$ to $R_5$ are independently a hydrogen or a substituent group, and M represents a monovalent metal atom) and (iv) formula (4):

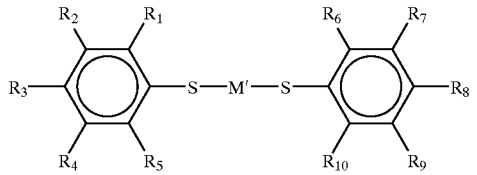

(wherein $R_1$ to $R_{10}$ are independently a hydrogen or a substituent group, and M' represents a bivalent metal atom)

of which the substituent be selected from the group (A) consisting of halogen group (F, Cl, Br, I), alkyl group, carboxyl group (—COOH) or ester thereof (—COOR), formyl group (—CHO), acyl group (—COR), halogenated carbonyl group (—COX), sulfo group (—$SO_3H$) or ester thereof (—$SO_3R$), halogenated sulfonyl group (—$SO_2X$), sulfino group (—$SO_2H$), alkylsulfinyl group (—SOR), carbamoyl group (—$CONH_2$), halogenated alkyl group, cyano group (—CN), alkoxy group (—OR) and combinations thereof.

Examples of the organic sulfur compounds represented by the formula (1) include thiophenol; and compounds substituted with one substituent group, such as thiophenols substituted with halogen group, such as 4-fluorothiophenol, 2,5-difluorothiophenol, 2,4,5-trifluorothiophenol, 2,4,5,6-tetrafluorothiophenol, pentafluorothiophenol, 4-chlorothiophenol, 2,5-dichlorothiophenol, 2,4,5-trichlorothiophenol, 2,4,5,6-tetrachlorothiophenol, pentachlorothiophenol, 4-bromothiophenol, 2,5-dibromothiophenol, 2,4,5-tribromothiophenol, 2,4,5,6-tetrabromothiophenol, pentabromothiophenol, 4-iodothiophenol, 2,5-diiodothiophenol, 2,4,5-triiodothiophenol, 2,4,5,6-tetraiodothiophenol, pentaiodothiophenol; thiophenols substituted with alkyl group, such as 4-methylthiophenol, 2,4,5-trimethylthiophenol, pentamethylthiophenol, 4-t-butylthiophenol, 2,4,5-tri-t-butylthiophenol, penta-t-butylthiophenol; thiophenols substituted with carboxyl group, such as 4-carboxythiophenol, 2,4,6-tricarboxythiophenol, pentacarboxythiophenol; thiophenols substituted with alkoxycarbonyl group, such as 4-methoxycarbonylthiophenol, 2,4,6-trimethoxycarbonylthiophenol, pentamethoxycarbonylthiophenol; thiophenols substituted with formyl group, such as 4-formylthiophenol, 2,4,6-triformylthiophenol, pentaformylthiophenol; thiophenols substituted with acyl group, such as 4-acetylthiophenol, 2,4,6-triacetylthiophenol, pentaacetylthiophenol; thiophenols substituted with halogenated carbonyl group, such as 4-chlorocarbonylthiophenol, 2,4,6-tri(chlorocarbonyl)thiophenol, penta(chlorocarbonyl) thiophenol; thiophenols substituted with sulfo group, such as 4-sulfothiophenol, 2,4,6-trisulfothiophenol, pentasulfothiophenol; thiophenols substituted with alkoxysulfonyl group, such as 4-methoxysulfonylthiophenol, 2,4,6-trimethoxysulfonylthiophenol, pentamethoxysulfonyithiophenol; thiophenols substituted with halogenated sulfonyl group, such as 4-chlorosulfonylthiophenol, 2,4,6-tri (chlorosulfonyl)thiophenol, penta(chlorosulfonyl) thiophenol; thiophenols substituted with sulfino group, such as 4-sulfinothiophenol, 2,4,6-trisulfinothiophenol, pentasulfinothiophenol; thiophenols substituted with alkylsulfinyl group, such as 4-methylsulfinylthiophenol, 2,4,6-tri (methylsulfinyl)thiophenol, penta(methylsulfinyl) thiophenol; thiophenols substituted with carbamoyl group, such as 4-carbamoylthiophenol, 2,4,6-tricarbamoylthiophenol, pentacarbamoylthiophenol; thiophenols substituted with halogenated alkyl group, such as 4-trichloromethylthiophenol, 2,4,6-tri(trichloromethyl) thiophenol, penta(trichloromethyl)thiophenol; thiophenols substituted with cyano group, such as 4-cyanothiophenol, 2,4,6-tricyanothiophenol, pentacyanothiophenol; thiophenols substituted with alkoxy group, such as 4-methoxythiophenol, 2,4,6-trimethoxythiophenol, pentamethoxythiophenol; and the like.

The organic sulfur compounds represented by the formula (1) include compounds further substituted with another substituent group, such as nitro group (—$NO_2$), amino group (—$NH_2$), hydroxyl group (—OH) and phenylthio group (—SPh) in addition to at least one of the substituent group selected from the group (A). Examples thereof include 4-chloro-2-nitrothiophenol, 4-chloro-2-aminothiophenol, 4-chloro-2-hydroxythiophenol, 4-chloro-2-phenylthiothiophenol, 4-methyl-2-nitrothiophenol, 4-methyl-2-aminothiophenol, 4-methyl-2-hydroxythiophenol, 4-methyl-2-phenylthiothiophenol, 4-carboxy-2-nitrothiophenol, 4-carboxy-2-aminothiophenol, 4-carboxy-2-hydroxythiophenol, 4-carboxy-2-phenylthiothiophenol, 4-methoxycarbonyl-2-nitrothiophenol, 4-methoxycarbonyl-2-aminothiophenol, 4-methoxycarbonyl-2-hydroxythiophenol, 4-methoxycarbonyl-2-phenylthiothiophenol, 4-formyl-2-nitrothiophenol, 4-formyl-2-aminothiophenol, 4-formyl-2-hydroxythiophenol, 4-formyl-2-phenylthiothiophenol, 4-acetyl-2-nitrothiophenol, 4-acetyl-2-aminothiophenol, 4-acetyl-2-hydroxythiophenol, 4-acetyl-2-phenylthiothiophenol, 4-chlorocarbonyl-2-nitrothiophenol, 4-chlorocarbonyl-2-aminothiophenol, 4-chlorocarbonyl-2-hydroxythiophenol, 4-chlorocarbonyl-2-phenylthiothiophenol, 4-sulfo-2-nitrothiophenol, 4-sulfo-2-aminothiophenol, 4-sulfo-2-hydroxythiophenol, 4-sulfo-2-phenylthiothiophenol, 4-methoxysulfonyl-2-nitrothiophenol, 4-methoxysulfonyl-2-aminothiophenol, 4-methoxysulfonyl-2-hydroxythiophenol, 4-methoxysulfonyl-2-phenylthiothiophenol, 4-chlorosulfonyl-2-nitrothiophenol, 4-chlorosulfonyl-2-aminothiophenol, 4-chlorosulfonyl-2-hydroxythiophenol, 4-chlorosulfonyl-2-phenylthiothiophenol, 4-sulfino-2-nitrothiophenol, 4-sulfino-2-aminothiophenol, 4-sulfino-2-hydroxythiophenol, 4-sulfino-2-phenylthiothiophenol, 4-methylsulfinyl-2-nitrothiophenol, 4-methylsulfinyl-2-aminothiophenol, 4-methylsulfinyl-2-hydroxythiophenol, 4-methylsulfinyl-2-phenylthiothiophenol, 4-carbamoyl-2-nitrothiophenol, 4-carbamoyl-2-aminothiophenol, 4-carbamoyl-2-hydroxythiophenol, 4-carbamoyl-2-phenylthiothiophenol, 4-trichloromethyl-2-nitrothiophenol, 4-trichloromethyl-2-aminothiophenol, 4-trichloromethyl-2-hydroxythiophenol, 4-trichloromethyl-2-phenylthiothiophenol, 4-cyano-2-nitrothiophenol, 4-cyano-2-aminothiophenol, 4-cyano-2-hydroxythiophenol, 4-cyano-2-phenylthiothiophenol, 4-methoxy-2-nitrothiophenol, 4-methoxy-2-aminothiophenol, 4-methoxy-2-hydroxythiophenol, 4-methoxy-2-phenylthiothiophenol and the like.

The organic sulfur compounds represented by the formula (1) include compounds substituted with two or more of the substituent groups. Examples thereof include 4-acetyl-2-chlorothiophenol, 4-acetyl-2-methylthiophenol, 4-acetyl-2-carboxythiophenol, 4-acetyl-2-methoxycarbonylthiophenol, 4-acetyl-2-formylthiophenol, 4-acetyl-2-chlorocarbonylthiophenol, 4-acetyl-2-sulfothiophenol, 4-acetyl-2-methoxysulfonylthiophenol, 4-acetyl-2-chlorosulfonylthiophenol, 4-acetyl-2-sulfinothiophenol, 4-acetyl-2-methylsulfinylthiophenol, 4-acetyl-2-carbamoylthiophenol, 4-acetyl-2-trichloromethylthiophenol, 4-acetyl-2-cyanothiophenol, 4-acetyl-2-methoxythiophenol and the like.

Examples of the organic sulfur compounds represented by the formula (2) include diphenyl disulfide; and compounds substituted with one substituent group, such as diphenyl disulfides substituted with halogen group, such as bis(4-fluorophenyl)disulfide, bis(2,5-difluorophenyl)disulfide, bis(2,4,5-trifluorophenyl)disulfide, bis(2,4,5,6-tetrafluorophenyl)disulfide, bis(pentafluorophenyl)disulfide, bis(4-chlorophenyl)disulfide, bis(2,5-dichlorophenyl)disulfide, bis(2,4,5-trichlorophenyl)disulfide, bis(2,4,5,6-tetrachlorophenyl)disulfide, bis(pentachlorophenyl)disulfide, bis(4-bromophenyl)disulfide, bis(2,5-dibromophenyl)disulfide, bis(2,4,5-tribromophenyl)disulfide, bis(2,4,5,6-tetrabromophenyl)disulfide, bis(pentabromophenyl)disulfide, bis(4-iodophenyl)disulfide, bis(2,5-diiodophenyl)disulfide, bis(2,4,5-triiodophenyl)disulfide, bis(2,4,5,6-tetraiodophenyl)disulfide, bis(pentaiodophenyl)disulfide; diphenyl disulfides substituted with alkyl group, such as bis(4-methylphenyl)disulfide, bis(2,4,5-trimethylphenyl)disulfide, bis(pentamethylphenyl)disulfide, bis(4-t-butylphenyl)disulfide, bis(2,4,5-trit-butylphenyl)disulfide, bis(penta-t-butylphenyl)disulfide; diphenyl disulfides substituted with carboxyl group, such as bis(4-carboxyphenyl)disulfide, bis(2,4,6-tricarboxyphenyl)disulfide, bis(pentacarboxyphenyl)disulfide; diphenyl disulfides substituted with alkoxycarbonyl group, such as bis(4-methoxycarbonylphenyl)disulfide, bis(2,4,6-trimethoxycarbonylphenyl)disulfide, bis(pentamethoxycarbonylphenyl)disulfide; diphenyl disulfides substituted with formyl group, such as bis(4-formylphenyl)disulfide, bis(2,4,6-triformylphenyl)disulfide, bis(pentaformylphenyl)disulfide; diphenyl disulfides substituted with acyl group, such as bis(4-acetylphenyl)disulfide, bis(2,4,6-triacetylphenyl)disulfide, bis(pentaacetylphenyl)disulfide; diphenyl disulfides substituted with halogenated carbonyl group, such as bis(4-chlorocarbonylphenyl)disulfide, bis(2,4,6-tri(chlorocarbonyl)phenyl)disulfide, bis(penta(chlorocarbonyl)phenyl)disulfide; diphenyl disulfides substituted with sulfo group, such as bis(4-sulfophenyl)disulfide, bis(2,4,6-trisulfophenyl)disulfide, bis(pentasulfophenyl)disulfide; diphenyl disulfides substituted with alkoxysulfonyl group, such as bis(4-methoxysulfonylphenyl)disulfide, bis(2,4,6-trimethoxysulfonylphenyl)disulfide, bis(pentamethoxysulfonylphenyl)disulfide; diphenyl disulfides substituted with halogenated sulfonyl group, such as bis(4-chlorosulfonylphenyl)disulfide, bis(2,4,6-tri(chlorosulfonyl)phenyl)disulfide, bis(penta(chlorosulfonyl)phenyl)disulfide; diphenyl disulfides substituted with sulfino group, such as bis(4-sulfinophenyl)disulfide, bis(2,4,6-trisulfinophenyl)disulfide, bis(pentasulfinophenyl)disulfide; diphenyl disulfides substituted with alkylsulfinyl group, such as bis(4-methylsulfinylphenyl)disulfide, bis(2,4,6-tri(methylsulfinyl)phenyl)disulfide, bis(penta(methylsulfinyl)phenyl)disulfide; diphenyl disulfides substituted with carbamoyl group, such as bis(4-carbamoylphenyl)disulfide, bis(2,4,6-tricarbamoylphenyl)disulfide, bis(pentacarbamoylphenyl)disulfide; diphenyl disulfides substituted with halogenated alkyl group, such as bis(4-trichloromethylphenyl)disulfide, bis(2,4,6-tri(trichloromethyl)phenyl)disulfide, bis(penta(trichloromethyl)phenyl)disulfide; diphenyl disulfides substituted with cyano group, such as bis(4-cyanophenyl)disulfide, bis(2,4,6-tricyanophenyl)disulfide, bis(pentacyanophenyl)disulfide; diphenyl disulfides substituted with alkoxy group, such as bis(4-methoxyphenyl)disulfide, bis(2,4,6-trimethoxyphenyl)disulfide, bis(pentamethoxyphenyl)disulfide; and the like.

The organic sulfur compounds represented by the formula (2) include compounds further substituted with another substituent group, such as nitro group (—$NO_2$), amino group (—$NH_2$), hydroxyl group (—OH) and phenylthio group (—SPh) in addition to at least one of the substituent group selected from the group (A). Examples thereof include bis(4-chloro-2-nitrophenyl)disulfide, bis(4-chloro-2-aminophenyl)disulfide, bis(4-chloro-2-hydroxyphenyl)disulfide, bis(4-chloro-2-phenylthiophenyl)disulfide, bis(4-methyl-2-nitrophenyl)disulfide, bis(4-methyl-2-aminophenyl)disulfide, bis(4-methyl-2-hydroxyphenyl)disulfide, bis(4-methyl-2-phenylthiophenyl)disulfide, bis(4-carboxy-2-nitrophenyl)disulfide, bis(4-carboxy-2-aminophenyl)disulfide, bis(4-carboxy-2-hydroxyphenyl)disulfide, bis(4-carboxy-2-phenylthiophenyl)disulfide, bis (4-methoxycarbonyl-2-nitrophenyl)disulfide, bis(4-methoxycarbonyl-2-aminophenyl)disulfide, bis(4-methoxycarbonyl-2-hydroxyphenyl)disulfide, bis(4-methoxycarbonyl-2-phenylthiophenyl)disulfide, bis(4-formyl-2-nitrophenyl)disulfide, bis(4-formyl-2-aminophenyl)disulfide, bis(4-formyl-2-hydroxyphenyl)disulfide, bis(4-formyl-2-phenylthiophenyl)disulfide, bis(4-acetyl-2-nitrophenyl)disulfide, bis(4-acetyl-2-aminophenyl)disulfide, bis(4-acetyl-2-hydroxyphenyl)disulfide, bis(4-acetyl-2-phenylthiophenyl)disulfide, bis(4-chlorocarbonyl-2-nitrophenyl)disulfide, bis(4-chlorocarbonyl-2-aminophenyl)disulfide, bis(4-chlorocarbonyl-2-hydroxyphenyl)disulfide, bis(4-chlorocarbonyl-2-phenylthiophenyl)disulfide, bis(4-sulfo-2-nitrophenyl)disulfide, bis(4-sulfo-2-aminophenyl)disulfide, bis(4-sulfo-2-hydroxyphenyl)disulfide, bis(4-sulfo-2-phenylthiophenyl)disulfide, bis(4-methoxysulfonyl-2-nitrophenyl)disulfide, bis(4-methoxysulfonyl-2-aminophenyl)disulfide, bis(4-methoxysulfonyl-2-hydroxyphenyl)disulfide, bis(4-methoxysulfonyl-2-phenylthiophenyl)disulfide, bis(4-chlorosulfonyl-2-nitrophenyl)disulfide, bis(4-chlorosulfonyl-2-aminophenyl)disulfide, bis(4-chlorosulfonyl-2-hydroxyphenyl)disulfide, bis(4-chlorosulfonyl-2-phenylthiophenyl)disulfide, bis(4-sulfino-2-nitrophenyl)disulfide, bis(4-sulfino-2-aminophenyl)disulfide, bis(4-sulfino-2-hydroxyphenyl)disulfide, bis(4-sulfino-2-phenylthiophenyl)disulfide, bis(4-methylsulfinyl-2-nitrophenyl)disulfide, bis(4-methylsulfinyl-2-aminophenyl)disulfide, bis(4-methylsulfinyl-2-hydroxyphenyl)disulfide, bis(4-methylsulfinyl-2-phenylthiophenyl)disulfide, bis(4-carbamoyl-2-nitrophenyl)disulfide, bis(4-carbamoyl-2-aminophenyl)disulfide, bis(4-carbamoyl-2-hydroxyphenyl)disulfide, bis(4-carbamoyl-2-phenylthiophenyl)disulfide, bis(4-trichloromethyl-2-nitrophenyl)disulfide, bis(4-trichloromethyl-2-aminophenyl)disulfide, bis(4-trichloromethyl-2-hydroxyphenyl)disulfide, bis(4-trichloromethyl-2-phenylthiophenyl)disulfide, bis(4-cyano-2-nitrophenyl)disulfide, bis(4-cyano-2-aminophenyl)disulfide, bis(4-cyano-2-hydroxyphenyl)disulfide, bis(4-cyano-2-phenylthiophenyl)disulfide, bis(4-methoxy-2-nitrophenyl)disulfide, bis(4-methoxy-2-aminophenyl)disulfide, bis(4-methoxy-2-hydroxyphenyl)disulfide, bis(4-methoxy-2-phenylthiophenyl)disulfide and the like.

The organic sulfur compounds represented by the formula (2) include compounds substituted with two or more of the substituent groups. Examples thereof include bis(4-acetyl-2-chlorophenyl)disulfide, bis(4-acetyl-2-methylphenyl)disulfide, bis(4-acetyl-2-carboxyphenyl)disulfide, bis(4-acetyl-2-methoxycarbonylphenyl)disulfide, bis(4-acetyl-2-formylphenyl)disulfide, bis(4-acetyl-2-chlorocarbonylphenyl)disulfide, bis(4-acetyl-2-sulfophenyl)disulfide, bis(4-acetyl-2-methoxysulfonylphenyl)disulfide, bis(4-acetyl-2-chlorosulfonylphenyl)disulfide, bis(4-acetyl-2-sulfinophenyl) disulfide, bis(4-acetyl-2-methylsulfinylphenyl)disulfide, bis(4-acetyl-2-carbamoylphenyl)disulfide, bis(4-acetyl-2-trichloromethylphenyl)disulfide, bis(4-acetyl-2-cyanophenyl)disulfide, bis(4-acetyl-2-methoxyphenyl)disulfide and the like.

Examples of the organic sulfur compounds represented by the formula (3) include thiophenol sodium salt; and compounds substituted with one substituent group, such as thiophenol sodium salts substituted with halogen group, such as 4-fluorothiophenol sodium salt, 2,5-difluorothiophenol sodium salt, 2,4,5-trifluorothiophenol sodium salt, 2,4,5,6-tetrafluorothiophenol sodium salt, pentafluorothiophenol sodium salt, 4-chlorothiophenol sodium salt, 2,5-dichlorothiophenol sodium salt, 2,4,5-trichlorothiophenol sodium salt, 2,4,5,6-tetrachlorothiophenol sodium salt, pentachlorothiophenol sodium salt, 4-bromothiophenol sodium salt, 2,5-dibromothiophenol sodium salt, 2,4,5-tribromothiophenol sodium salt, 2,4,5,6-tetrabromothiophenol sodium salt, pentabromothiophenol sodium salt, 4-iodothiophenol sodium salt, 2,5-diiodothiophenol sodium salt, 2,4,5-triiodothiophenol sodium salt, 2,4,5,6-tetraiodothiophenol sodium salt, pentaiodothiophenol sodium salt; thiophenol sodium salts substituted with alkyl group, such as 4-methylthiophenol sodium salt, 2,4,5-trimethylthiophenol sodium salt, pentamethylthiophenol sodium salt, 4-t-butylthiophenol sodium salt, 2,4,5-tri-t-butylthiophenol sodium salt, penta(t-butyl)thiophenol sodium salt; thiophenol sodium salts substituted with carboxyl group, such as 4-carboxythiophenol sodium salt, 2,4,6-tricarboxythiophenol sodium salt, pentacarboxythiophenol sodium salt; thiophenol sodium salts substituted with alkoxycarbonyl group, such as 4-methoxycarbonylthiophenol sodium salt, 2,4,6-trimethoxycarbonylthiophenol sodium salt, pentamethoxycarbonylthiophenol sodium salt; thiophenol sodium salts substituted with formyl group, such as 4-formylthiophenol sodium salt, 2,4,6-triformylthiophenol sodium salt, pentaformylthiophenol sodium salt; thiophenol sodium salts substituted with acyl group, such as 4-acetylthiophenol sodium salt, 2,4,6-triacetylthiophenol sodium salt, pentaacetylthiophenol sodium salt; thiophenol sodium salts substituted with halogenated carbonyl group, such as 4-chlorocarbonylthiophenol sodium salt, 2,4,6-tri(chlorocarbonyl)thiophenol sodium salt, penta(chlorocarbonyl)thiophenol sodium salt; thiophenol sodium salts substituted with sulfo group, such as 4-sulfothiophenol sodium salt, 2,4,6-trisulfothiophenol sodium salt, pentasulfothiophenol sodium salt; thiophenol sodium salts substituted with alkoxysulfonyl group, such as 4-methoxysulfonylthiophenol sodium salt, 2,4,6-trimethoxysulfonylthiophenol sodium salt, pentamethoxysulfonylthiophenol sodium salt; thiophenol sodium salts substituted with halogenated sulfonyl group, such as 4-chlorosulfonylthiophenol sodium salt, 2,4,6-tri(chlorosulfonyl)thiophenol sodium salt, penta(chlorosulfonyl)thiophenol sodium salt; thiophenol sodium salts substituted with sulfino group, such as 4-sulfinothiophenol sodium salt, 2,4,6-trisulfinothiophenol sodium salt, pentasulfinothiophenol sodium salt; thiophenol sodium salts substituted with alkylsulfinyl group, such as 4-methylsulfinylthiophenol sodium salt, 2,4,6-tri(methylsulfinyl)thiophenol sodium salt, penta(methylsulfinyl)thiophenol sodium salt; thiophenol sodium salts substituted with carbamoyl group, such as 4-carbamoylthiophenol sodium salt, 2,4,6-tricarbamoylthiophenol sodium salt, pentacarbamoylthiophenol sodium salt; thiophenol sodium salts substituted with halogenated alkyl group, such as 4-trichloromethylthiophenol sodium salt, 2,4,6-tri(trichloromethyl)thiophenol sodium salt, penta(trichloromethyl)thiophenol sodium salt; thiophenol sodium salts substituted with cyano group, such as 4-cyanothiophenol sodium salt, 2,4,6-tricyanothiophenol sodium salt, pentacyanothiophenol sodium salt; thiophenol sodium salts substituted with alkoxy group, such as 4-methoxythiophenol sodium salt, 2,4,6-trimethoxythiophenol sodium salt, pentamethoxythiophenol sodium salt; and the like.

The organic sulfur compounds represented by the formula (3) include compounds further substituted with another substituent group, such as nitro group (—$NO_2$), amino group (—$NH_2$), hydroxyl group (—OH) and phenylthio group (—SPh) in addition to at least one of the substituent group selected from the group (A). Examples thereof include 4-chloro-2-nitrothiophenol sodium salt, 4-chloro-2-aminothiophenol sodium salt, 4-chloro-2-hydroxythiophenol sodium salt, 4-chloro-2-phenylthiothiophenol sodium salt, 4-methyl-2-nitrothiophenol sodium salt, 4-methyl-2-aminothiophenol sodium salt, 4-methyl-2-hydroxythiophenol sodium salt, 4-methyl-2-phenylthiothiophenol sodium salt, 4-carboxy-2-nitrothiophenol sodium salt, 4-carboxy-2-aminothiophenol sodium salt, 4-carboxy-2-hydroxythiophenol sodium salt, 4-carboxy-2-phenylthiothiophenol sodium salt, 4-methoxycarbonyl-2-nitrothiophenol sodium salt, 4-methoxycarbonyl-2-aminothiophenol sodium salt, 4-methoxycarbonyl-2-hydroxythiophenol sodium salt, 4-methoxycarbonyl-2-phenylthiothiophenol sodium salt, 4-formyl-2-nitrothiophenol sodium salt, 4-formyl-2-aminothiophenol sodium salt, 4-formyl-2-hydroxythiophenol sodium salt, 4-formyl-2-phenylthiothiophenol sodium salt, 4-acetyl-2-nitrothiophenol, 4-acetyl-2-aminothiophenol sodium salt, 4-acetyl-2-hydroxythiophenol sodium salt, 4-acetyl-2-phenylthiothiophenol sodium salt, 4-chlorocarbonyl-2-nitrothiophenol sodium salt, 4-chlorocarbonyl-2-aminothiophenol sodium salt, 4-chlorocarbonyl-2-hydroxythiophenol sodium salt, 4-chlorocarbonyl-2-phenylthiothiophenol sodium salt, 4-sulfo-2-nitrothiophenol sodium salt, 4-sulfo-2-aminothiophenol sodium salt, 4-sulfo-2-hydroxythiophenol sodium salt, 4-sulfo-2-phenylthiothiophenol sodium salt, 4-methoxysulfonyl-2-nitrothiophenol sodium salt, 4-methoxysulfonyl-2-aminothiophenol sodium salt, 4-methoxysulfonyl-2-hydroxythiophenol sodium salt, 4-methoxysulfonyl-2-phenylthiothiophenol sodium salt, 4-chlorosulfonyl-2-nitrothiophenol sodium salt, 4-chlorosulfonyl-2-aminothiophenol sodium salt, 4-chlorosulfonyl-2-hydroxythiophenol sodium salt, 4-chlorosulfonyl-2-phenylthiothiophenol sodium salt, 4-sulfino-2-nitrothiophenol sodium salt, 4-sulfino-2-aminothiophenol sodium salt, 4-sulfino-2-hydroxythiophenol sodium salt, 4-sulfino-2-phenylthiothiophenol sodium salt, 4-methylsulfinyl-2-nitrothiophenol sodium salt, 4-methylsulfinyl-2-aminothiophenol sodium salt, 4-methylsulfinyl-2-hydroxythiophenol sodium salt, 4-methylsulfinyl-2-phenylthiothiophenol sodium salt, 4-carbamoyl-2-nitrothiophenol sodium salt, 4-carbamoyl-2-aminothiophenol sodium salt, 4-carbamoyl-2-hydroxythiophenol sodium salt, 4-carbamoyl-2-phenylthiothiophenol sodium salt, 4-trichloromethyl-2-nitrothiophenol sodium salt, 4-trichloromethyl-2-aminothiophenol sodium salt, 4-trichloromethyl-2-hydroxythiophenol sodium salt, 4-trichloromethyl-2-phenylthiothiophenol sodium salt, 4-cyano-2-nitrothiophenol sodium salt, 4-cyano-2-aminothiophenol sodium salt, 4-cyano-2-hydroxythiophenol sodium salt, 4-cyano-2-phenylthiothiophenol sodium salt, 4-methoxy-2-nitrothiophenol sodium salt, 4-methoxy-2-aminothiophenol sodium salt, 4-methoxy-2-hydroxythiophenol sodium salt, 4-methoxy-2-phenylthiothiophenol sodium salt and the like.

The organic sulfur compounds represented by the formula (3) include compounds substituted with two or more of the substituent groups. Examples thereof include 4-acetyl-2-chlorothiophenol sodium salt, 4-acetyl-2-methylthiophenol sodium salt, 4-acetyl-2-carboxythiophenol sodium salt, 4-acetyl-2-methoxycarbonylthiophenol sodium salt, 4-acetyl-2-formylthiophenol sodium salt, 4-acetyl-2-chlorocarbonylthiophenol sodium salt, 4-acetyl-2-sulfothiophenol sodium salt, 4-acetyl-2-methoxysulfonylthiophenol sodium salt, 4-acetyl-2-chlorosulfonylthiophenol sodium salt, 4-acetyl-2-sulfinothiophenol sodium salt, 4-acetyl-2-methylsulfinylthiophenol sodium salt, 4-acetyl-2-carbamoylthiophenol sodium salt, 4-acetyl-2-trichloromethylthiophenol sodium salt, 4-acetyl-2-cyanothiophenol sodium salt, 4-acetyl-2-methoxythiophenol sodium salt and the like. In the examples of the organic sulfur compounds represented by the formula (3), the monovalent metal atom represented by M other than the sodium includes lithium, potassium, copper (I), silver (I) and the like.

Examples of the organic sulfur compounds represented by the formula (4) include thiophenol zinc salt; and compounds substituted with one substituent group, such as thiophenol zinc salts substituted with halogen group, such as 4-fluorothiophenol zinc salt, 2,5-difluorothiophenol zinc salt, 2,4,5-trifluorothiophenol zinc salt, 2,4,5,6-tetrafluorothiophenol zinc salt, pentafluorothiophenol zinc salt, 4-chlorothiophenol zinc salt, 2,5-dichlorothiophenol zinc salt, 2,4,5-trichlorothiophenol zinc salt, 2,4,5,6-tetrachlorothiophenol zinc salt, pentachlorothiophenol zinc salt, 4-bromothiophenol zinc salt, 2,5-dibromothiophenol zinc salt, 2,4,5-tribromothiophenol zinc salt, 2,4,5,6-tetrabromothiophenol zinc salt, pentabromothiophenol zinc salt, 4-iodothiophenol zinc salt, 2,5-diiodothiophenol zinc salt, 2,4,5-triiodothiophenol zinc salt, 2,4,5,6-tetraiodothiophenol zinc salt, pentaiodothiophenol zinc salt; thiophenol zinc salts substituted with alkyl group, such as 4-methylthiophenol zinc salt, 2,4,5-trimethylthiophenol zinc salt, pentamethylthiophenol zinc salt, 4-t-butylthiophenol zinc salt, 2,4,5-tri-t-butylthiophenol zinc salt, penta(t-butyl) thiophenol zinc salt; thiophenol zinc salts substituted with carboxyl group, such as 4-carboxythiophenol zinc salt, 2,4,6-tricarboxythiophenol zinc salt, pentacarboxythiophenol zinc salt; thiophenol zinc salts substituted with alkoxycarbonyl group, such as 4-methoxycarbonylthiophenol zinc salt, 2,4,6-trimethoxycarbonylthiophenol zinc salt, pentamethoxycarbonylthiophenol zinc salt; thiophenol zinc salts substituted with formyl group, such as 4-formylthiophenol zinc salt, 2,4,6-triformylthiophenol zinc salt, pentaformylthiophenol zinc salt; thiophenol zinc salts substituted with acyl group, such as 4-acetylthiophenol zinc salt, 2,4,6-triacetylthiophenol zinc salt, pentaacetylthiophenol zinc salt; thiophenol zinc salts substituted with halogenated carbonyl group, such as 4-chlorocarbonylthiophenol zinc salt, 2,4,6-tri(chlorocarbonyl)thiophenol zinc salt, penta (chlorocarbonyl)thiophenol zinc salt; thiophenol zinc salts substituted with sulfo group, such as 4-sulfothiophenol zinc salt, 2,4,6-trisulfothiophenol zinc salt, pentasulfothiophenol zinc salt; thiophenol zinc salts substituted with alkoxysulfonyl group, such as 4-methoxysulfonylthiophenol zinc salt, 2,4,6-trimethoxysulfonylthiophenol zinc salt, pentamethoxysulfonylthiophenol zinc salt; thiophenol zinc salts substituted with halogenated sulfonyl group, such as 4-chlorosulfonylthiophenol zinc salt, 2,4,6-tri (chlorosulfonyl)thiophenol zinc salt, penta(chlorosulfonyl) thiophenol zinc salt; thiophenol zinc salts substituted with sulfino group, such as 4-sulfinothiophenol zinc salt, 2,4,6-trisulfinothiophenol zinc salt, pentasulfinothiophenol zinc salt; thiophenol zinc salts substituted with alkylsulfinyl group, such as 4-methylsulfinylthiophenol zinc salt, 2,4,6-tri(methylsulfinyl)thiophenol zinc salt, penta (methylsulfinyl)thiophenol zinc salt; thiophenol zinc salts substituted with carbamoyl group, such as 4-carbamoylthiophenol zinc salt, 2,4,6-tricarbamoylthiophenol zinc salt, pentacarbamoylthiophenol zinc salt; thiophenol zinc salts substituted with halogenated alkyl group, such as 4-trichloromethylthiophenol zinc salt, 2,4,6-tri(trichloromethyl)thiophenol zinc salt, penta (trichloromethyl)thiophenol zinc salt; thiophenol zinc salts substituted with cyano group, such as 4-cyanothiophenol zinc salt, 2,4,6-tricyanothiophenol zinc salt, pentacyanothiophenol zinc salt; thiophenol zinc salts substituted with alkoxy group, such as 4-methoxythiophenol zinc salt, 2,4,6-trimethoxythiophenol zinc salt, pentamethoxythiophenol zinc salt; and the like.

The organic sulfur compounds represented by the formula (4) include compounds further substituted with another substituent group, such as nitro group (—$NO_2$), amino group (—$NH_2$), hydroxyl group (—OH) and phenylthio group (—SPh) in addition to at least one of the substituent group selected from the group (A). Examples thereof include 4-chloro-2-nitrothiophenol zinc salt, 4-chloro-2-aminothiophenol zinc salt, 4-chloro-2-hydroxythiophenol zinc salt, 4-chloro-2-phenylthiothiophenol zinc salt, 4-methyl-2-nitrothiophenol zinc salt, 4-methyl-2-aminothiophenol zinc salt, 4-methyl-2-hydroxythiophenol zinc salt, 4-methyl-2-phenylthiothiophenol zinc salt, 4-carboxy-2-nitrothiophenol zinc salt, 4-carboxy-2-aminothiophenol zinc salt, 4-carboxy-2-hydroxythiophenol zinc salt, 4-carboxy-2-phenylthiothiophenol zinc salt, 4-methoxycarbonyl-2-nitrothiophenol zinc salt, 4-methoxycarbonyl-2-aminothiophenol zinc salt, 4-methoxycarbonyl-2-hydroxythiophenol zinc salt, 4-methoxycarbonyl-2-phenylthiothiophenol zinc salt, 4-formyl-2-nitrothiophenol zinc salt, 4-formyl-2-aminothiophenol zinc salt, 4-formyl-2-hydroxythiophenol zinc salt, 4-formyl-2-phenylthiothiophenol zinc salt, 4-acetyl-2-nitrothiophenol, 4-acetyl-2-aminothiophenol zinc salt, 4-acetyl-2-hydroxythiophenol zinc salt, 4-acetyl-2-phenylthiothiophenol zinc salt, 4-chlorocarbonyl-2-nitrothiophenol zinc salt, 4-chlorocarbonyl-2-aminothiophenol zinc salt, 4-chlorocarbonyl-2-hydroxythiophenol zinc salt, 4-chlorocarbonyl-2-phenylthiothiophenol zinc salt, 4-sulfo-2-nitrothiophenol zinc salt, 4-sulfo-2-aminothiophenol zinc salt, 4-sulfo-2-hydroxythiophenol zinc salt, 4-sulfo-2-phenylthiothiophenol zinc salt, 4-methoxysulfonyl-2-nitrothiophenol zinc salt, 4-methoxysulfonyl-2-aminothiophenol zinc salt, 4-methoxysulfonyl-2-hydroxythiophenol zinc salt, 4-methoxysulfonyl-2-phenylthiothiophenol zinc salt, 4-chlorosulfonyl-2-nitrothiophenol zinc salt, 4-chlorosulfonyl-2-aminothiophenol zinc salt, 4-chlorosulfonyl-2-hydroxythiophenol zinc salt, 4-chlorosulfonyl-2-phenylthiothiophenol zinc salt, 4-sulfino-2-nitrothiophenol zinc salt, 4-sulfino-2-aminothiophenol zinc salt, 4-sulfino-2-hydroxythiophenol zinc salt, 4-sulfino-2-phenylthiothiophenol zinc salt, 4-methylsulfinyl-2-nitrothiophenol zinc salt, 4-methylsulfinyl-2-aminothiophenol zinc salt, 4-methylsulfinyl-2-hydroxythiophenol zinc salt, 4-methylsulfinyl-2-phenylthiothiophenol zinc salt, 4-carbamoyl-2-nitrothiophenol zinc salt, 4-carbamoyl-2-aminothiophenol zinc salt, 4-carbamoyl-2-hydroxythiophenol zinc salt, 4-carbamoyl-2-phenylthiothiophenol zinc salt, 4-trichloromethyl-2-nitrothiophenol zinc salt, 4-trichloromethyl-2-aminothiophenol zinc salt, 4-trichloromethyl-2-hydroxythiophenol zinc salt, 4-trichloromethyl-2-phenylthiothiophenol zinc salt, 4-cyano-2-nitrothiophenol zinc salt, 4-cyano-2-aminothiophenol zinc salt, 4-cyano-2-hydroxythiophenol zinc salt, 4-cyano-2-phenylthiothiophenol zinc salt, 4-methoxy-2-nitrothiophenol zinc salt, 4-methoxy-2-aminothiophenol zinc salt, 4-methoxy-2-hydroxythiophenol zinc salt, 4-methoxy-2-phenylthiothiophenol zinc salt and the like.

The organic sulfur compounds represented by the formula (4) include compounds substituted with two or more of the substituent groups. Examples thereof include 4-acetyl-2-chlorothiophenol zinc salt, 4-acetyl-2-methylthiophenol zinc salt, 4-acetyl-2-carboxythiophenol zinc salt, 4-acetyl-2-methoxycarbonylthiophenol zinc salt, 4-acetyl-2-formylthiophenol zinc salt, 4-acetyl-2-chlorocarbonylthiophenol zinc salt, 4-acetyl-2-sulfothiophenol zinc salt, 4-acetyl-2-methoxysulfonylthiophenol zinc salt, 4-acetyl-2-chlorosulfonylthiophenol zinc salt, 4-acetyl-2-sulfinothiophenol zinc salt, 4-acetyl-2-methylsulfinylthiophenol zinc salt, 4-acetyl-2-carbamoylthiophenol zinc salt, 4-acetyl-2-trichloromethylthiophenol zinc salt, 4-acetyl-2-cyanothiophenol zinc salt, 4-acetyl-2-methoxythiophenol zinc salt and the like. In the examples of the organic sulfur compounds represented by the formula (4), the divalent metal atom represented by M' other than the zinc includes magnesium, calcium, strontium, barium, titanium (II), manganese (II), iron (II), cobalt (II), nickel (II), zirconium (II), tin (II) and the like.

The amount of the organic sulfur compound is from 0.05 to 5.0 parts by weight, preferably 0.1 to 3.0 parts by weight, based on 100 parts by weight of the base rubber. When the amount of the organic sulfur compound is smaller than 0.05 parts by weight, the technical effects accomplished by the presence of the organic sulfur compound are not sufficiently obtained. On the other hand, when the amount of the organic sulfur compound is larger than 5.0 parts by weight, the deformation amount is large, which degrades the rebound characteristics, and the technical effects accomplished by the presence of the organic sulfur compound are not sufficiently obtained. The detail mechanism of the technical effects of improving the rebound characteristics by the organic sulfur compound is not obvious, but the reason is considered that a crosslinking structure, which imparts high rebound characteristics to the core, is formed.

The rubber compositions for the core of the golf ball of the present invention can contain a hydroquinone compound. The hydroquinone compound is at least one selected from the group consisting of compounds which are represented by the following formula (5):

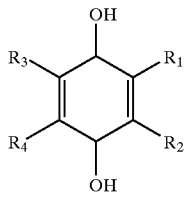

(wherein $R_1$ to $R_4$ are independently a hydrogen or a substituent group) and the substituent is selected from the group (A) consisting of halogen group (F, Cl, Br, I), alkyl group, carboxyl group (—COOH) or ester thereof (—COOR), formyl group (—CHO), acyl group (—COR), halogenated carbonyl group (—COX), sulfo group ($—SO_3H$) or ester thereof ($—SO_3R$), halogenated sulfonyl group ($—SO_2X$), sulfino group ($—SO_2H$), alkylsulfinyl group (—SOR), carbamoyl group ($—CONH_2$), halogenated alkyl group, cyano group (—CN), alkoxy group (—OR) and combinations thereof.

Examples of the hydroquinone compounds represented by the formula (5) include hydroquinone, 2-chlorohydroquinone, 2-bromohydroquinone, 2,5-dichlorohydroquinone, 2,5-dibromohydroquinone, tetrachlorohydroquinone, tetrabromohydroquinone, 2-methylhydroquinone, 2-t-butylhydroquinone, 2,5-di-t-butylhydroquinone, 2,5-di-t-amylhydroquinone and the like. The amount of the hydroquinone compound is from 0.002 to 5 parts by weight, preferably from 0.005 to 1 parts by weight, more preferably from 0.005 to 0.1 parts by weight, based on 100 parts by weight of the base rubber. When the amount of the hydroquinone compound is smaller than 0.002 parts by weight, the technical effects accomplished by the presence of the hydroquinone compound are not sufficiently obtained. On the other hand, when the amount of the hydroquinone compound is larger than 5 parts by weight, the deformation amount is large, and the rebound characteristics are degraded. Therefore, the technical effects of improving rebound characteristics accomplished by the presence of the hydroquinone compound are not sufficiently obtained.

The rubber compositions for the core of the golf ball of the present invention can contain other components, which have been conventionally used for preparing the core of solid golf balls, such as antioxidant or peptizing agent. If used, the amount of the antioxidant is preferably 0.2 to 0.5 parts by weight, based on 100 parts by weight of the base rubber.

The core used for the golf ball of the present invention can be obtained by mixing the above rubber composition with a proper mixing machine such as a mixing roll, and then vulcanizing and press-molding the mixture under applied heat in a mold. The vulcanizing, of which the condition is not limited, is conducted at 130 to 240° C. and 2.9 to 11.8 MPa for 15 to 60 minutes.

In the golf ball of the present invention, it is suitable for the core to have a diameter of 32.8 to 41.2 mm, preferably 33.6 to 40.0 mm. When the diameter of the core is smaller than 32.8 mm, the rebound characteristics are degraded, which reduces the flight distance. On the other hand, when the diameter is larger than 41.2 mm, the thickness of the cover is too small, and the durability of the resulting golf ball is poor.

The core used in the golf ball of the present invention may have single-layered structure or multi-layered structure, which has two or more layers, as long as at least one layer of the core is formed by the rubber composition, of which the calculated volume content of the co-crosslinking agent and the total calculated volume content of the base rubber and the co-crosslinking agent, based on the total core volume, are adjusted to specified ranges. It is preferable that a ratio ($V_C/V_B$) of a volume of the core portion containing the rubber composition described above ($V_C$) to the total volume of the golf ball ($V_B$) be not less than 0.3, preferably not less than 0.5, more preferably not less than 0.6. When the volume ratio ($V_C/V_B$) is too small, the rebound characteristics are degraded, which reduces the flight distance. On the other hand, when the volume ratio ($V_C/V_B$) is too large, the cover is too thin, and the durability of the resulting golf ball is poor. Therefore, it is preferable for the volume ratio ($V_C/V_B$) to be not more than 0.9, preferably not more than 0.8.

In the golf ball of the present invention, it is required for the core to have the center hardness in JIS-C hardness of 40 to 60, preferably 45 to 59, more preferably 45 to 55. When the center hardness is lower than 40, the core is too soft, and the rebound characteristics of the resulting golf ball are degraded, which reduces the flight distance. On the other hand, when the center hardness is higher than 60, the core is too hard, and the deformation amount at the time of hitting is small, which reduces the launch angle. Therefore, the flight performance is poor.

In the golf ball of the present invention, it is required for the core to have the surface hardness in JIS-C hardness of 80 to 95, preferably 82 to 90, more preferably 83 to 89. When the surface hardness is lower than 80, the rebound characteristics of the core are degraded, which degrades the flight performance of the resulting golf ball. On the other hand, when the surface hardness is higher than 95, the shot feel of the resulting golf ball is hard and poor.

In the golf ball of the present invention, it is required for the core to have a hardness difference (B–A) between a hardness in JIS-C hardness at a distance of 5 mm from the center point of the core (B) and the center hardness (A) of not less than 1 to less than 10, preferably 1 to 8, more preferably 2 to 8. When the hardness difference is not less than 10, hardness distribution from a portion at a distance of 5 mm from the center point to the surface of the core is nearly even, and the shot feel is poor. On the other hand, when the hardness difference is smaller than 1, the shot feel is poor.

In the golf ball of the present invention, it is desired for the core to have the hardness in JIS-C hardness at a distance of 5 mm from the center point of the core (B) of 41 to 69, preferably 47 to 67, more preferably 50 to 67. When the hardness (B) is lower than 41, the core is soft, and the rebound characteristics of the resulting golf ball are degraded, which degrades the flight performance. On the other hand, when the hardness (B) is higher than 69, the deformation amount at the time of hitting is small, and the launch angle is small, which degrades the flight performance. In the golf ball of the present invention, it is desired for the core to have a hardness in JIS-C hardness at a distance of 10 mm from the center point of the core of 55 to 85, preferably 60 to 80, more preferably 65 to 75, and it is desired for the core to have a hardness in JIS-C hardness at a distance of 15 mm from the center point of the core of 60 to 90, preferably 65 to 85, more preferably 75 to 85.

The term "surface hardness of the core" as used herein refers to the hardness, which is determined by measuring a hardness at the surface of the resulting core formed by vulcanizing and press-molding. The term "center hardness of the core" or "hardness at a distance of 5 mm from the center point of the core" as used herein refers to the hardness, which is determined by cutting the resulting core into two equal parts and then measuring a JIS-C hardness at its center point or at a distance of 5 mm from the center point in section.

In the golf ball of the present invention, it is desired for the core to have a deformation amount when applying from an initial load of 98 N to a final load of 1275 N of 2.5 to 5.5 mm, preferably 2.8 to 4.5 mm, more preferably 3.0 to 4.5 mm. When the deformation amount of the center is smaller than 2.5 mm, the core is too hard, and the shot feel of the resulting golf ball is poor. On the other hand, when the deformation amount is larger than 5.5 mm, the core is too soft, and the durability of the resulting golf ball is poor. In addition, the rebound characteristics are degraded, which reduces the flight distance. A cover is then covered on the core obtained as described above.

The cover used in the golf ball pertaining to the present invention may comprise a single-layered structure, or a multi-layered structure comprising two or more layers. The cover of the present invention contains thermoplastic resin, particularly ionomer resin, which has been conventionally used for the cover of golf balls, as a base resin. The ionomer resin may be a copolymer of ethylene and α,β-unsaturated carboxylic acid, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum ion, a tin ion, a zirconium ion, cadmium ion, and the like. Preferred are sodium ions, zinc ions, magnesium ions and the like, in view of rebound characteristics, durability and the like.

The ionomer resin is not limited, but examples thereof will be shown by a trade name thereof. Examples of the ionomer resins, which are commercially available from Du Pont-Mitsui Polychemicals Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856 and the like. Examples of the ionomer resins, which are commercially available from Du Pont Co., include Surlyn 8945, Surlyn 9945, Surlyn AD8511, Surlyn AD8512, Surlyn AD8542 and the like. Examples of the ionomer resins, which are commercially available from Exxon Chemical Co., include Iotek 7010, Iotek 8000 and the like. These ionomer resins may be used alone or in combination.

As the materials suitably used in the cover of the present invention, the above ionomer resin may be used alone, but the ionomer resin may be used in combination with at least one of thermoplastic elastomer and the like.

Examples of the thermoplastic elastomers include polyamide-based thermoplastic elastomer, which is commercially available from Toray Co., Ltd. under the trade name of "Pebax" (such as "Pebax 2533"); polyester-based thermoplastic elastomer, which is commercially available from Toray-Do Pont Co., Ltd. under the trade name of "Hytrel" (such as "Hytrel 3548", "Hytrel 4047"); polyurethane-based elastomer, which is commercially available from BASF Polyurethane Elastomers Co., Ltd. under the trade name of "Elastollan" (such as "Elastollan ET880"); and the like.

The cover composition used in the present invention may optionally contain fillers as used for the core, pigments (such as titanium dioxide, etc.) and the other additives such as a dispersant, an antioxidant, a UV absorber, a photostabilizer and a fluorescent agent or a fluorescent brightener, etc., in addition to the above resin component as long as the addition of the additives does not deteriorate the desired performance of the golf ball cover. If used, the amount of the pigment is preferably 0.1 to 5.0 parts by weight, based on 100 parts by weight of the resin component for the cover.

A method of covering on the core with the cover is not specifically limited, but may be a conventional method. For example, there can be used a method comprising molding the cover composition into a semi-spherical half-shell in advance, covering the core, with the two half-shells, followed by pressure molding at 130 to 170° C. for 1 to 5 minutes, or a method comprising injection molding the cover composition directly on the core to cover it.

In the golf ball of the present invention, it is desired for the cover to have a thickness of 0.8 to 5.0 mm, preferably 1.0 to 4.0 mm, more preferably 1.0 to 2.5 mm. When the thickness is smaller than 0.8 mm, the cover is too thin, and the durability and the rebound characteristics of the resulting golf ball are poor. On the other hand, when the thickness is larger than 5.0 mm, the shot feel of the resulting golf ball is poor.

At the time of molding the cover, many depressions called "dimples" may be optionally formed on the surface of the golf ball. Furthermore, paint finishing or marking with a stamp may be optionally provided after the cover molded for commercial purposes.

The diameter of golf balls is limited to not less than 42.67 mm in accordance with the regulations for golf balls as described above. Generally, when the diameter of the golf ball is large, air resistance of the golf ball on a flight is large, which reduces the flight distance. Therefore, most of golf balls commercially available are designed to have a diameter of 42.67 to 42.82 mm. The present invention is applicable to the golf balls having the diameter. There are golf balls having large diameter in order to improve the easiness of hitting. In addition, there are cases where golf balls having a diameter out of the regulations for golf balls are required depending on the demand and object of users. Therefore, it can be considered for golf balls to have a diameter of 42 to 44 mm, more widely 40 to 45 mm. The present invention is also applicable to the golf balls having the diameter.

In the golf ball of the present invention, it is desired to have a deformation amount when applying from an initial load of 98 N to a final load of 1275 N of 2.3 to 3.2 mm, preferably 2.4 to 3.1 mm, more preferably 2.5 to 3.0 mm. When the deformation amount is smaller than 2.3 mm, the golf ball is too hard, and the shot feel is hard and poor. On the other hand, when the deformation amount is larger than 3.2 mm, the rebound characteristics of the resulting golf ball are degraded, which reduces the flight distance.

EXAMPLES

The following Examples and Comparative Examples further illustrate the present invention in detail but are not to be construed to limit the scope of the present invention thereto.

Production of Cores

The rubber compositions for the core having formulations shown in Tables 1 to 2 (Examples) and Table 3 (Comparative Examples) were mixed with a mixing roll and then vulcanized by press-molding at 160° C. for 30 minutes in the mold to obtain spherical core having a diameter of 39.0 mm. The hardness distribution (center point, 5 mm from the center point, 10 mm from the center point, 15 mm from the center point and the surface), deformation amount and coefficient of restitution of the resulting core were measured, and the results are shown in Tables 5 to 6 (Examples) and Tables 7 (Comparative Examples).

TABLE 1

| Core composition | (parts by weight) Example No. 1 | 2 | 3 | 4 |
|---|---|---|---|---|
| BR-18 *1 | 100 | 100 | 100 | 100 |
| Zinc acrylate | 37.5 | 37.5 | 37.5 | 37.5 |
| Zinc oxide | 16.5 | 16.5 | 16.5 | 16.5 |
| Dicumyl peroxide | 0.6 | 0.6 | 0.6 | 0.8 |
| Bis(pentachlorophenyl) disulfide | 1.3 | 1.3 | 1.3 | 1.3 |
| Bis(pentabromophenyl) disulfide | — | — | — | — |
| Hydroquinone | 0.01 | — | — | — |
| 2-methyl hydroquinone | — | 0.01 | — | — |
| 2-t-butyl hydroquinone | — | — | 0.01 | — |

TABLE 2

| Core composition | (parts by weight) Example No. 5 | 6 | 7 |
|---|---|---|---|
| BR-18 *1 | 100 | 100 | 100 |
| Zinc acrylate | 35.0 | 33.0 | 37.5 |
| Zinc oxide | 17.4 | 18.2 | 16.5 |
| Dicumyl peroxide | 0.6 | 0.6 | 0.55 |
| Bis(pentachlorophenyl) disulfide | — | 0.9 | 1.3 |
| Bis(pentabromophenyl) disulfide | 1.6 | — | — |
| Hydroquinone | 0.01 | — | — |
| 2-methyl hydroquinone | — | 0.01 | — |
| 2-t-butyl hydroquinone | — | — | 0.005 |

TABLE 3

| Core composition | (parts by weight) Comparative Example No. 1 | 2 | 3 |
|---|---|---|---|
| BR-18 *1 | 100 | 100 | 100 |
| Zinc acrylate | 33 | 25 | 33.5 |
| Zinc oxide | 18.2 | 21.0 | 18.0 |
| Dicumyl peroxide | 1.0 | 1.4 | 0.6 |
| Diphenyl disulfide | 0.5 | 0.5 | — |
| bis(pentachlorophenyl) disulfide | — | — | 0.4 |

*1 High-cis polybutadiene commercially available from JSR Co., Ltd., under the trade name "BR-18"

Preparation of Cover Compositions

The formulation materials for the cover showed in Table 4 were mixed using a kneading type twin-screw extruder to obtain pelletized cover compositions. The extrusion condition was, a screw diameter of 45 mm, a screw speed of 200 rpm, a screw L/D of 35.

The formulation materials were heated at 200 to 260° C. at the die position of the extruder

TABLE 4

| Cover composition | Amount (parts by weight) |
|---|---|
| Hi-milan 1555 *3 | 10 |
| Hi-milan 1855 *4 | 45 |
| Hi-milan 1856 *5 | 45 |

TABLE 4-continued

| Cover composition | Amount (parts by weight) |
|---|---|
| Titanium dioxide | 2 |
| Barium sulfate | 2 |

*3 Hi-milan 1555 (trade name), ethylene-methacrylic acid copolymer ionomer resin obtained by neutralizing with sodium ion, manufactured by Du Pont-Mitsui Polychemicals Co., Ltd.

*4 Hi-milan 1855 (trade name), ethylene-methacrylic acid-alkyl acrylate terpolymer ionomer resin obtained by neutralizing with zinc ion, manufactured by Du Pont-Mitsui Polychemicals Co., Ltd.

*5 Hi-milan 1856 (trade name), ethylene-methacrylic acid-alkyl acrylate terpolymer ionomer resin obtained by neutralizing with sodium ion, manufactured by Du Pont-Mitsui Polychemicals Co., Ltd.

Examples 1 to 7 and Comparative Examples 1 to 3

A cover layer having a thickness of 1.9 mm was formed by molding the cover composition into a semi-spherical half-shell in advance, covering the core with the two half-shells, followed by press molding. Then, a paint was applied on the surface to produce a two-piece golf ball having a diameter of 42.8 mm. The deformation amount and flight distance of the resulting golf balls were measured and the shot feel of the resulting golf balls was evaluated. The results are shown in Tables 5 to 6 (Examples) and Tables 7 (Comparative Examples). The test methods are as follows.

Test Method (1) Hardness of Core

The surface hardness of the core was determined by measuring a JIS-C hardness at the surface of the resulting core. The center hardness, hardness at a distance of 5 mm from the center point, hardness at a distance of 10 mm from the center point and hardness at a distance of 15 mm from the center point of the core were determined by cutting the resulting core into two equal parts and then measuring a JIS-C hardness at its center point, and at positions of 5 mm, 10 mm and 15 mm from the center point in section. The JIS-C hardness was measured using a JIS-C hardness meter according to JIS K6301.

(2) Deformation Amount of Core or Golf Ball

The deformation amount of core or golf ball was determined by measuring a deformation amount when applying from an initial load of 98 N to a final load of 1275 N on the core or golf ball.

(3) Coefficient of Restitution of Core

A metal cylinder having a weight of 198.4 g was struck at a speed of 40 m/sec against a core, and the velocities of the core and the cylinder before and after the strike were measured. The coefficient of restitution of the core was calculated from the velocity and the weight of both the cylinder and the core. The measurement was conducted 12 times for each golf ball, and the average is shown as the coefficient of restitution of the golf ball.

(4) Flight Distance

A No. 1 wood club (W#1, a driver) having metal head was mounted to a swing robot manufactured by True Temper Co. and the resulting golf ball was hit at a head speed of 50 m/second, the flight distance was measured. As the flight distance, carry that is a distance to the dropping point of the hit golf ball was measured. The measurement was conducted 12 times for each golf ball (n=12), and the average is shown as the result of the golf ball.

(5) Shot Feel

The shot feel of the resulting golf ball was evaluated by 10 professional golfers according to practical hitting test by a No. 1 wood club (W#1, a driver). The results shown in the Tables below are based on the fact that the most golfers evaluated with the same criterion about shot feel. The evaluation criteria are as follows.

Evaluation Criteria (Impact Force)

○: The golfers felt that the golf ball has soft and good shot feel such that impact force at the time of hitting is small.

Δ: The golfers felt that the golf ball has fairly good shot feel.

x: The golfers felt that the golf ball has poor shot feel such that impact force at the time of hitting is large.

(Rebound)

○: The golfers felt that the golf ball has good shot feel such that rebound characteristics are good.

Δ: The golfers felt that the golf ball has fairly good shot feel.

x: The golfers felt that the golf ball has poor shot feel such that rebound characteristics are poor.

TABLE 5

| Core composition | | Example No. 1 | 2 | 3 | 4 |
|---|---|---|---|---|---|
| (Core) Hardness distribution | | | | | |
| Center point (A) | | 52 | 52 | 52 | 53 |
| 5 mm from center point (B) | | 59 | 59 | 59 | 62 |
| 10 mm from center point | | 73 | 73 | 74 | 71 |
| 15 mm from center point | | 80 | 81 | 81 | 78 |
| Surface | | 87 | 88 | 89 | 84 |
| Hardness difference (B − A) | | 7 | 7 | 7 | 9 |
| Deformation amount (mm) | | 3.20 | 3.14 | 3.10 | 3.45 |
| Coefficient of restitution | | 0.792 | 0.793 | 0.794 | 0.787 |
| (Golf ball) | | | | | |
| Deformation amount (mm) | | 2.90 | 2.85 | 2.82 | 3.09 |
| Carry (m) | | 246 | 246 | 246 | 243 |
| Shot feel | Impact force | ○ | ○ | ○ | ○ |
| | Rebound | ○ | ○ | ○ | ○ |

TABLE 6

| Test item | | Example No. 5 | 6 | 7 |
|---|---|---|---|---|
| (Core) Hardness distribution | | | | |
| Center point (A) | | 55 | 59 | 45 |
| 5 mm from center point (B) | | 57 | 67 | 53 |
| 10 mm from center point | | 67 | 74 | 66 |
| 15 mm from center point | | 78 | 80 | 78 |
| Surface | | 83 | 85 | 90 |
| Hardness difference (B − A) | | 2 | 8 | 8 |
| Deformation amount (mm) | | 3.40 | 3.13 | 3.25 |
| Coefficient of restitution | | 0.788 | 0.793 | 0.791 |
| (Golf ball) | | | | |
| Deformation amount (mm) | | 3.05 | 2.85 | 2.94 |
| Carry (m) | | 244 | 246 | 244 |
| Shot feel | Impact force | ○ | ○ | ○ |
| | Rebound | ○ | ○ | ○ |

TABLE 7

| Test item | | Comparative Example No. 1 | 2 | 3 |
|---|---|---|---|---|
| (Core) Hardness distribution | | | | |
| Center point (A) | | 60 | 65 | 58 |
| 5 mm from center point (B) | | 77 | 72 | 72 |
| 10 mm from center point | | 80 | 75 | 78 |
| 15 mm from center point | | 84 | 77 | 81 |
| Surface | | 87 | 79 | 88 |
| Hardness difference (B − A) | | 17 | 7 | 14 |
| Deformation amount (mm) | | 3.00 | 3.05 | 3.17 |
| Coefficient of restitution | | 0.784 | 0.782 | 0.787 |
| (Golf ball) | | | | |
| Deformation amount (mm) | | 2.75 | 2.79 | 2.75 |
| Carry (m) | | 234 | 233 | 240 |
| Shot feel | Impact force | ○ | ○ | x |
| | Rebound | Δ | x | Δ |

As is apparent from Tables 5 to 7, the golf balls of Examples 1 to 7 of the present invention, when compared with the golf balls of Comparative Examples 1 to 3, have exceptional rebound characteristics and flight performance, as well as a good shot feel.

On the other hand, in the golf ball of Comparative Example 1, since the hardness difference (B−A) between the hardness at a distance of 5 mm from the center point (B) and the center hardness (A) of the core is large, hardness difference in whole core (between the surface hardness and center hardness) is large, but the shot feel is poor.

In the golf ball of Comparative Example 2, since the surface hardness of the core is low, the coefficient of restitution of the core is degraded, which reduces the flight distance of the resulting golf ball. In addition, the hardness difference in whole core is small, and the shot feel is poor.

In the golf ball of Comparative Example 3, since the center hardness of the core is low, the coefficient of restitution of the core is degraded, which reduces the flight distance of the resulting golf ball. In addition, the hardness difference (B−A) is large, and the shot feel is poor.

The above data were used to plot the relationship between the deformation amount of the core (x axis) and the coefficient of restitution of the core (y axis) for Examples 1 to 7 and Comparative Examples 1 to 3, and the results can be seen in FIG. 1. In FIG. 1, the deformation amount increases further along the X-axis, heading right, while the shock on impact decreases; these data reveal golf balls having exceptional shot feel. On the other hand, the coefficient of restitution increases further along the Y-axis, heading upwards; these data reveal golf balls having an enhanced flight distance. Accordingly, the data, which are uppermost and rightmost in the plot, reveal golf balls with exceptional shot feel and rebound characteristics (flight distance). As is readily understood from the FIGURE, Examples 1 to 7 pertaining to the present invention, of which the center hardness, the surface hardness and the hardness difference (B−A) between the hardness at a distance of 5 mm from the center point (B) and the center hardness (A) of the core are adjusted to specified ranges, all lie within the upper right-hand region of the plot, as compared with the golf balls pertaining to Comparative Examples 1 to 3.

In general, the deformation amount value in golf balls is set according to the performance demanded thereof. However, FIG. 1 shows that the coefficient of restitution of all of the Examples were greater than those of the Comparative Examples, irrespective of the deformation amount value in case of having similar degrees of deformation amount value. In other words, the rebound characteristics of golf balls which had similar degrees of deformation amount (shot feel) were exceptional in those balls pertaining to the Examples. Similarly, the deformation amount of golf balls, which had similar degrees of rebound characteristics (flight distance), was high, and the shot feel was good, in those balls pertaining to the Examples. To corroborate these findings, an evaluation of shot feel was conducted on Examples 4 and 5 and Comparative Example 3, all of which had nearly identical coefficient of restitution, alongside Examples 1 and 2 and Comparative Example 3, all of which had nearly identical deformation amount values.

As can be clearly understood from the data given in Tables 5 to 7, the golf balls pertaining to Examples 4 and 5 and to Comparative Example 3 had coefficient of restitution which were nearly the same, while the golf balls pertaining to Examples 4 and 5, which displayed very high deformation amount had markedly superior shot feel in comparison to the ball pertaining to Comparative Example 3. Furthermore, the golf balls pertaining to Examples 1 and 2 and to Comparative Example 3 all had similar deformation amount values and shot feel (impact force), while the golf balls pertaining to Examples 1 and 2 exhibited significantly higher coefficient of restitution and flight distance values and had superior shot feel (rebound) in comparison to the balls pertaining to Comparative Example 3.

What is claimed is:

1. A solid golf ball comprising at least one layer of a core, and at least one layer of a cover formed on the core, wherein at least one layer including the inmost layer of the core is formed by vulcanizing a rubber composition comprising a base rubber, a co-crosslinking agent, a vulcanization initiator and a filler, the core has a center hardness in JIS-C hardness of 40 to 60, a surface hardness in JIS-C hardness of 80 to 95 and a hardness difference (B–A) between a hardness in JIS-C hardness at a distance of 5 mm from the center point of the core (B) and the center hardness (A) of not less than 1 to less than 10;

wherein the rubber composition for the core comprises at least one organic sulfur compound selected from the group consisting of bis(pentachlorophenyl)disulfide and bis(pentabromophenyl)disulfide wherein the rubber composition for the core comprises further at least one hydroquinone compound selected from the group consisting of compounds which are represented by the following formula (5):

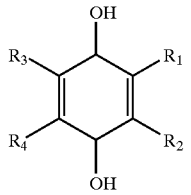

wherein $R_1$ to $R_4$ are independently a hydrogen or a substituent selected from the group the group consisting of a halogen group (F, Cl, Br, I), alkyl group, carboxyl group (—COOH) or ester thereof (—COOR), formyl group (—CHO), acyl group (—COR), halogenated carbonyl group (—COX), sulfo group (—$SO_3H$) or ester thereof (—$SO_3R$), halogenated sulfonyl group (—$SO_2X$), sulfino group (—$SO_2H$), alkylsulfinyl group (—SOR), carbamoyl group (—$CONH_2$), halogenated alkyl group, cyano group (—CN), alkoxy group (—OR) and combinations thereof; and the hydroquinone compound is present in an amount within the range of 0.002 to 5 parts by weight, based on 100 parts by weight of the base rubber.

2. The solid golf ball according to claim 1, wherein the organic sulfur compound is present in the rubber composition for the core in an amount of from 0.05 to 5.0 parts by weight based on 100 parts by weight of the base rubber.

3. The solid golf ball according to claim 1, wherein the organic sulfur compound is present in the rubber composition for the core in an amount of from 0.1 to 3.0 parts by weight based on 100 parts by weight of the base rubber.

4. The solid golf ball according to claim 1, wherein the core has a center hardness in JIS-C hardness of 45 to 59, a surface hardness in JIS-C hardness of 82 to 90 and a hardness difference (B–A) between a hardness in JIS-C hardness at a distance of 5 mm from the center point of the core (B) and the center hardness (A) of not less than 1 to 8.

5. The solid golf ball according to claim 1, wherein the core has a center hardness in JIS-C hardness of 45 to 55, a surface hardness in JIS-C hardness of 83 to 89 and a hardness difference (B–A) between a hardness in JIS-C hardness at a distance of 5 mm from the center point of the core (B) and the center hardness (A) of 2 to 8.

6. The solid golf ball according to claim 1, wherein the core has a hardness in JIS-C hardness at a distance of 5 mm from the center point of the core (B) of 41 to 69.

7. The solid golf ball according to claim 1, wherein the core has a hardness in JIS-C hardness at a distance of 5 mm from the center point of the core (B) of 50 to 67.

8. The solid golf ball according to claim 1, wherein the core has a hardness in JIS-C hardness at a distance of 10 mm from the center point of the core of 55 to 85.

9. The solid golf ball according to claim 1, wherein the core has a hardness in JIS-C hardness at a distance of 10 mm from the center point of the core of 65 to 75.

10. The solid golf ball according to claim 1, wherein the core has a hardness in JIS-C hardness at a distance of 15 mm from the center point of the core 60 to 90.

11. The solid golf ball according to claim 1, wherein the core has a hardness in JIS-C hardness at a distance of 15 mm from the center point of the core 75 to 85.

* * * * *